US010704307B1

(12) United States Patent
Collene et al.

(10) Patent No.: US 10,704,307 B1
(45) Date of Patent: Jul. 7, 2020

(54) ADJUSTABLE RECEIVER FOR APPLIANCE HINGE

(71) Applicant: Mansfield Engineered Components, Inc., Mansfield, OH (US)

(72) Inventors: James J. Collene, Bucyrus, OH (US); Brian S. White, Galion, OH (US)

(73) Assignee: Mansfield Engineered Components, Inc., Mansfield, OH (US)

( * ) Notice: Subject to any disclaimer, the term of this patent is extended or adjusted under 35 U.S.C. 154(b) by 0 days.

(21) Appl. No.: 16/107,771

(22) Filed: Aug. 21, 2018

Related U.S. Application Data

(60) Provisional application No. 62/548,588, filed on Aug. 22, 2017.

(51) Int. Cl.

| | |
|---|---|
| ***E05F 1/08*** | (2006.01) |
| ***E05D 7/04*** | (2006.01) |
| ***E05D 5/02*** | (2006.01) |
| ***E05D 11/10*** | (2006.01) |

(52) U.S. Cl.
CPC ..... *E05D 7/0423* (2013.01); *E05D 5/02* (2013.01); *E05D 11/10* (2013.01); *E05Y 2900/30* (2013.01); *E05Y 2900/308* (2013.01)

(58) Field of Classification Search
CPC ..... Y10T 16/5383; Y10T 16/54024; Y10T 16/54026; Y10T 16/54029; Y10T 16/5404; Y10T 16/5406; Y10T 16/5407; Y10T 16/544; Y10T 16/53225; Y10T 16/53253; E05F 3/20; E05F 3/14; E05F 3/16; E05F 3/18; E05F 3/22; E05F 1/12; E05F 1/1261; E05F 1/1284; E05F 5/02; E05D 3/122; E05D 2/02; E05D 11/1007; E05D 7/0423; E05D 7/0415; E05D 5/02; E05D 11/10; E05Y 2201/21; E05Y 2201/218; E05Y 2201/48; E05Y 2201/266; E05Y 2800/26; E05Y 2800/465; E05Y 2800/674; E05Y 2900/312; E05Y 2900/30; E05Y 2900/308; D06F 39/12
See application file for complete search history.

(56) References Cited

U.S. PATENT DOCUMENTS

| | | | | |
|---|---|---|---|---|
| 3,092,097 A | | 6/1963 | Moss | |
| 3,132,640 A | | 5/1964 | Chisholm et al. | |
| 4,021,968 A | * | 5/1977 | Kendall | E05F 1/1075 49/386 |

(Continued)

*Primary Examiner* — Chuck Y Mah
(74) *Attorney, Agent, or Firm* — Fay Sharpe LLP

(57) ABSTRACT

In accordance with one aspect of the present development, an adjustable receiver for an associated appliance hinge includes a base adapted to be secured to an associated appliance body. A first cross-member is connected to the base and is movable relative to the base. The first cross-member provides a first hinge mounting structure for an associated appliance hinge. A second cross-member is connected to the base and is movable relative to the base. At least one link extends between and interconnects the first and second cross-members. The first and second cross-members and the at least one link define an adjustable hinge mount that is selectively movable relative to the base along an adjustment axis. The adjustable receiver further includes an adjustment system for selectively altering a position of the adjustable hinge mount relative to the base along the adjustment axis.

20 Claims, 7 Drawing Sheets

(56) References Cited

U.S. PATENT DOCUMENTS

| | | | | |
|---|---|---|---|---|
| 7,150,071 | B2 | 12/2006 | Collene et al. | |
| 7,516,517 | B2 * | 4/2009 | Fries | E05D 7/02 16/246 |
| 8,307,504 | B2 | 11/2012 | Collene | |
| 8,683,653 | B2 * | 4/2014 | Bettinzoli | E05F 1/1261 16/286 |
| 9,074,404 | B2 | 7/2015 | DeLozier et al. | |
| 9,404,299 | B2 | 8/2016 | Braden et al. | |
| 2003/0172920 | A1 * | 9/2003 | Gronbach | E05D 7/12 126/197 |
| 2010/0212112 | A1 | 8/2010 | Steurer et al. | |
| 2013/0291853 | A1 * | 11/2013 | Braden | E05D 7/04 126/19 R |
| 2014/0109344 | A1 * | 4/2014 | Lee | E05D 3/12 16/304 |
| 2014/0208542 | A1 | 7/2014 | White | |

* cited by examiner

ADJUSTABLE RECEIVER FOR APPLIANCE HINGE

CROSS-REFERENCE TO RELATED APPLICATION

This application claims priority from and benefit of the filing date of U.S. provisional patent application Ser. No. 62/548,588 filed Aug. 22, 2017, and the entire disclosure of said provisional patent application Ser. No. 62/548,588 filed Aug. 22, 2017 is hereby expressly incorporated by reference into the present application.

BACKGROUND

Appliances such as ovens, dryers, dishwashers, and the like typically include a pair of hinge receivers connected to a front wall or other part of an appliance body, and a door of the appliance is pivotally connected to the appliance body by a corresponding pair of hinges that are connected to the door and that are also engaged with the respective receivers. In certain applications and circumstances, it is desirable to adjust the operative position of the hinge (and door connected thereto) relative to the appliance body without repositioning a base of the receiver relative to the body. This adjustment is sometimes accomplished by an adjustable receiver in which the base of the receiver is connected to the appliance body in a fixed location, and one or more internal hinge engagement or hinge mounting structure(s) of the receiver are selectively adjustable relative to the base of the receiver. In one such system, the receiver base is mounted to a vertical front wall of an oven and the vertical position of the oven door is adjusted by selectively altering the vertical position of one or more horizontal mounting rivets or other hinge mounting structures connected to the receiver base using an adjustment screw that is manually advanced or retracted by a user.

Although known adjustable receivers have found commercial success, an opportunity exists for a new and improved adjustable receiver that has a simplified construction with reduced material and assembly costs, while providing the required durability and overall performance for appliance applications.

SUMMARY

In accordance with one aspect of the present development, an adjustable receiver for an associated appliance hinge includes a base adapted to be secured to an associated appliance body. A first cross-member is connected to the base and is movable relative to the base. The first cross-member provides a first hinge mounting structure for an associated appliance hinge. A second cross-member is connected to the base and is movable relative to the base. At least one link extends between and interconnects the first and second cross-members. The first and second cross-members and the at least one link define an adjustable hinge mount that is selectively movable relative to the base along an adjustment axis. The adjustable receiver further includes an adjustment system for selectively altering a position of the adjustable hinge mount relative to the base along the adjustment axis.

DETAILED DESCRIPTION OF THE PRESENT DEVELOPMENT

Figure 1:
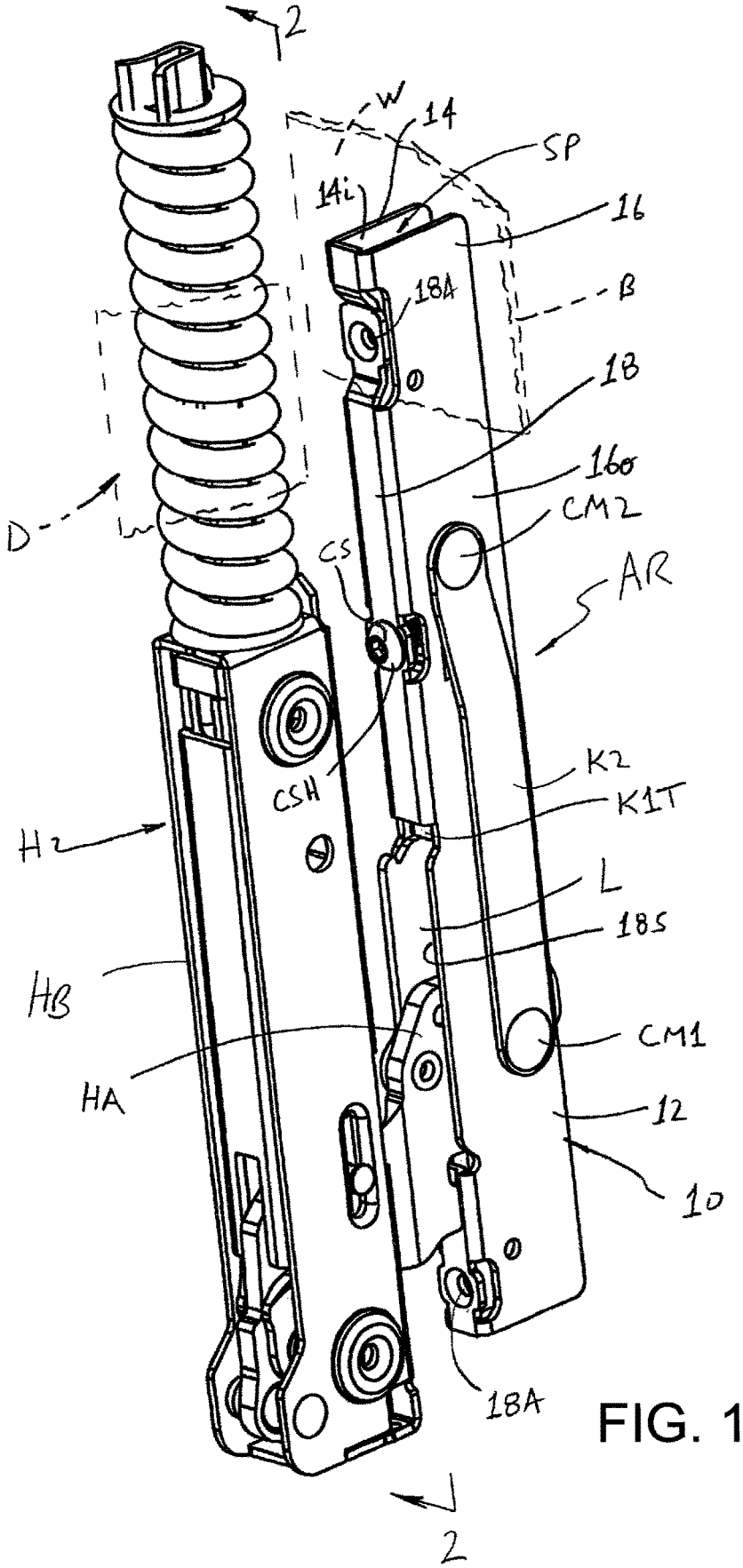
FIG. 1 is an isometric view of an adjustable receiver formed in accordance with an embodiment of the present development in its second or "intermediate" position, and also shows an associated hinge assembly operatively connected thereto.

FIG. 1 is an isometric view of an adjustable receiver AR formed in accordance with an embodiment of the present development connected to a front or other wall W of an appliance body B, e.g., a cooking oven body. An associated hinge assembly H is operatively connected to the adjustable receiver AR. The hinge assembly H comprises a hinge body HB that is adapted to be connected to an associated appliance door D. The term "door" as used herein encompasses any door, lid, or similar cover that pivots about a pivot axis (or axes) such as a vertical or a horizontal pivot axis (or axes) to selectively close and open a chamber located in an appliance body B and that opens through the wall W, such as a cooking chamber of an oven, a drying chamber of a clothes dryer, a cold chamber of a refrigerator/freezer, or the like.

The hinge assembly H also includes a mounting arm HA that is pivotally connected to the hinge body HB and that is adapted to be operatively and releasably connected to the adjustable receiver AR. In particular, as shown in the section view of FIG. 2, the hinge mounting arm HA includes one or more mounting slots, such as first and second mounting slots T1,T2, that are adapted to selectively engage, receive, and retain respective mounting structures of the adjustable receiver AR to operatively connect the hinge assembly H to the receiver AR, or the hinge mounting arm HA is otherwise structured or conformed to operatively mate with the adjustable receiver AR. In the illustrated embodiment, the adjustable receiver AR includes a first or primary mounting structure M1 that is engaged by the first slot T1 or other part of the hinge mounting arm HA and that is selectively adjustable or movable as described in detail below, and comprises a second or secondary mounting structure M2 that is engaged by the second slot T2 or other part of the hinge mounting arm HA. In the illustrated embodiment, the second mounting structure M2 immovable or fixed in position. Alternatively, the second mounting structure M2 is movable/adjustable and the first mounting structure M1 is immovably fixed in position, or both the first and second mounting structures M1,M2 of the receiver AR are movable/adjustable. The first and second mounting structures M1,M2 are described in further detail below.

Figure 2:
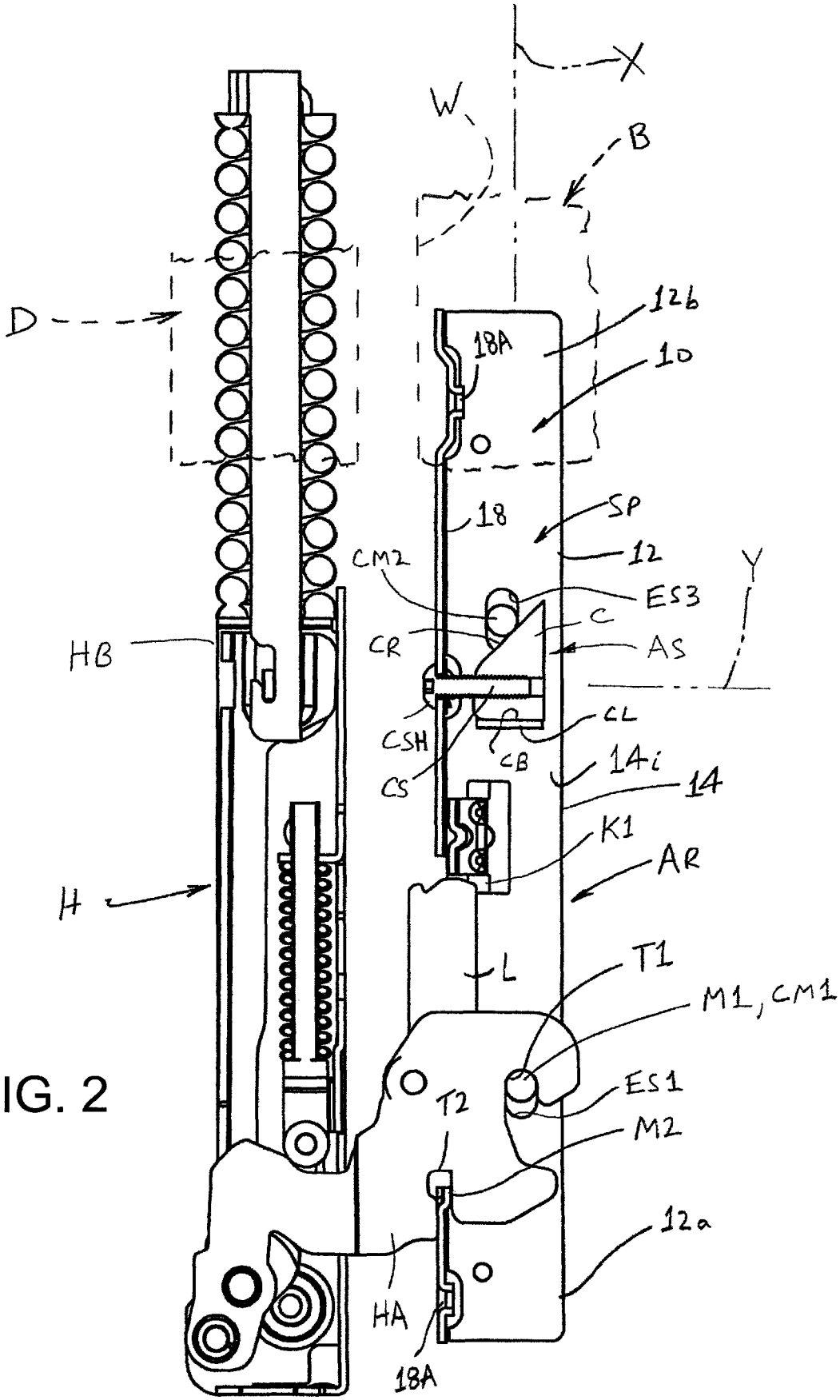
FIG. 2 is a section view of the adjustable receiver and associated hinge assembly of FIG. 1 as taken at line 2-2 of FIG. 1.
Figure 3:
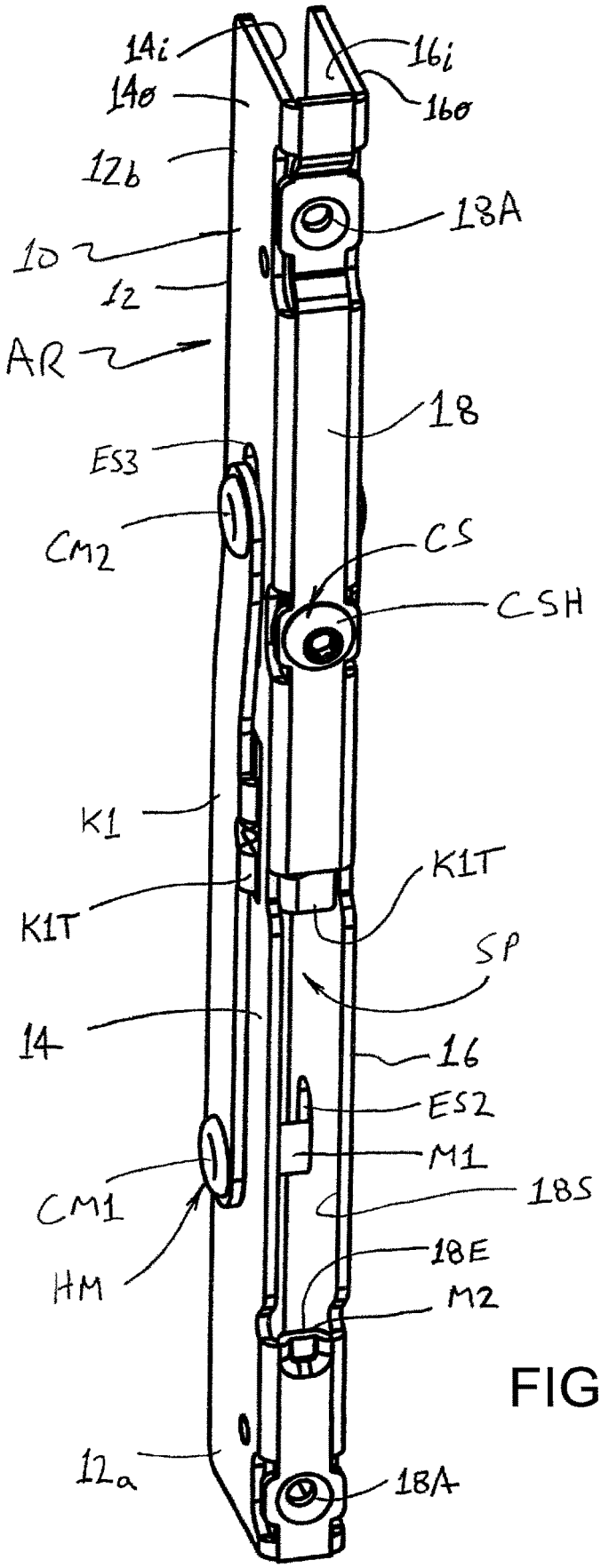
FIGS. 3 and 4 are respective left and right side isometric views of the adjustable receiver of FIG. 1, showing the adjustable receiver in its third operative or "down" position.
Figure 4:
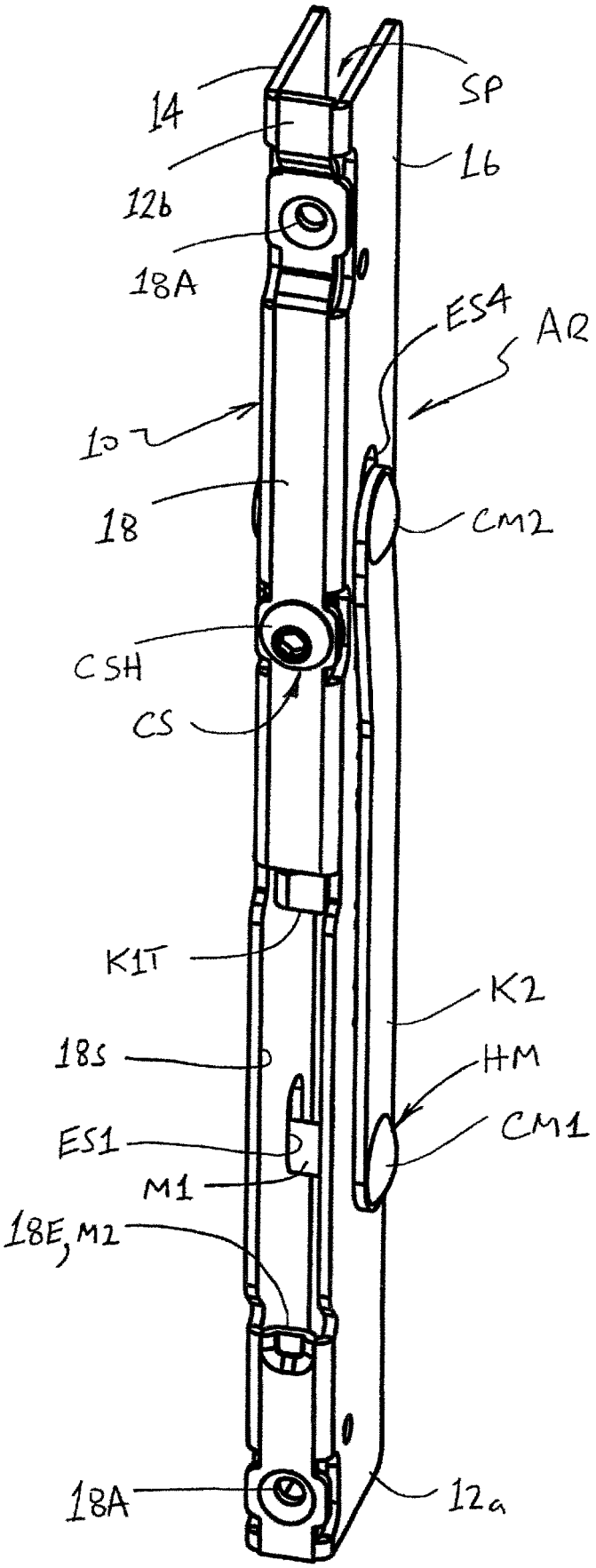
Figure 5:
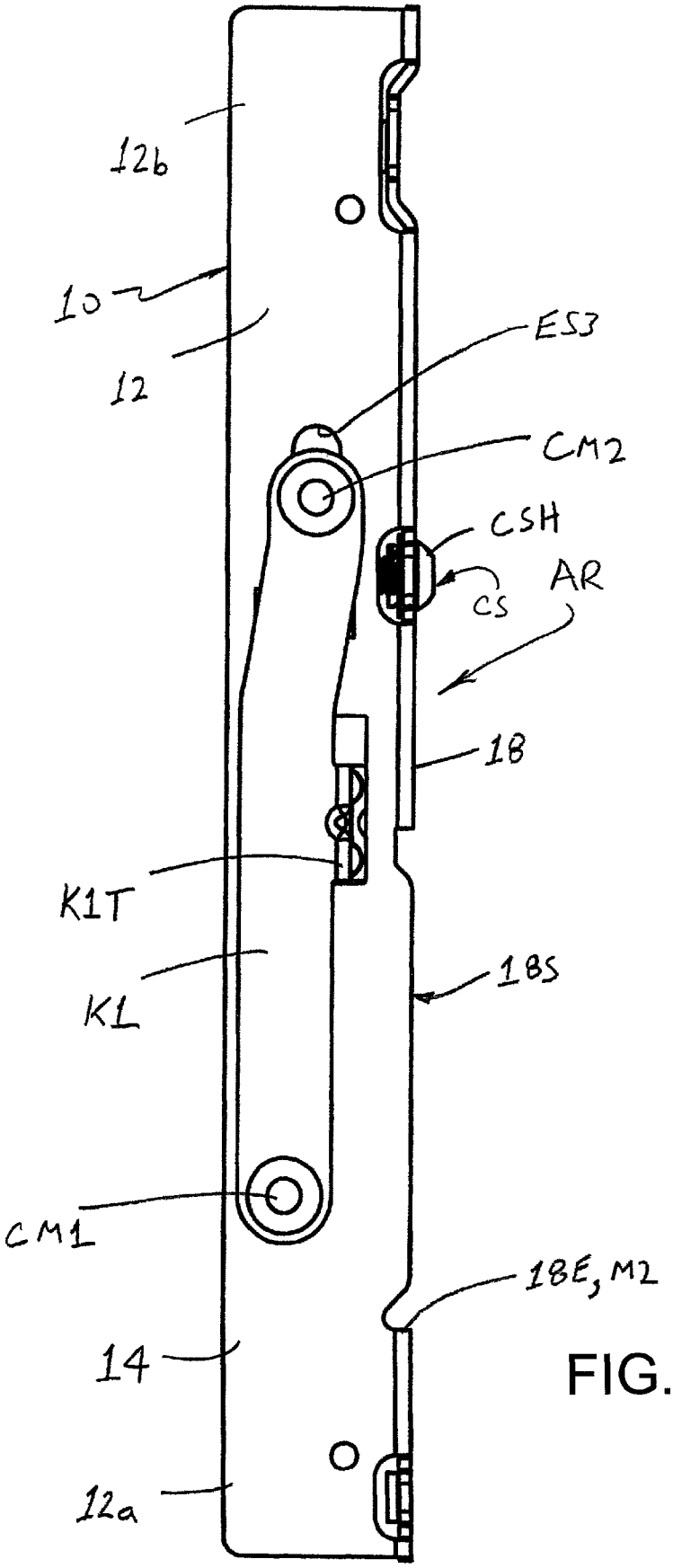
FIGS. 5 and 6 are respective left and right side views of the adjustable receiver of FIG. 1, showing the adjustable receiver in its third operative or "down" position.
Figure 6:
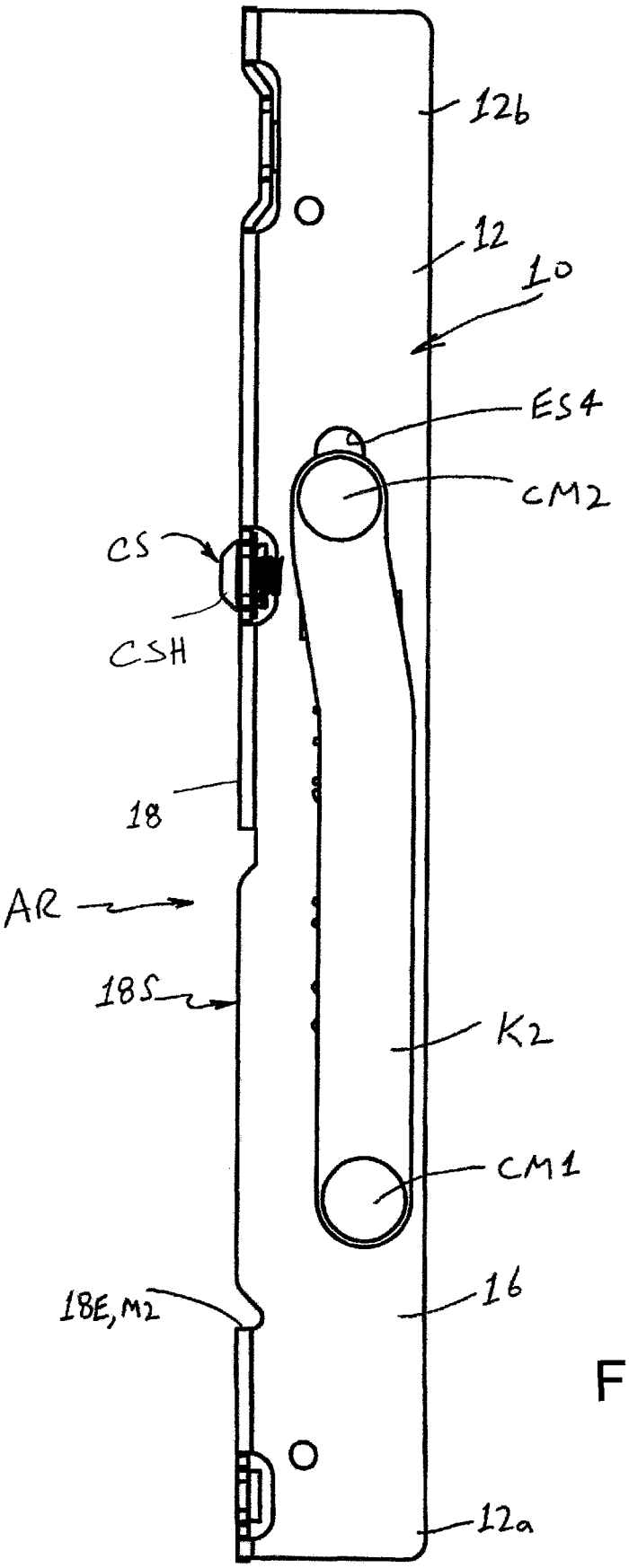

Referring now also FIGS. 3-7C, the adjustable receiver AR comprises a base 10 that is adapted and configured to be fixedly secured to a front wall W or other wall of an appliance body B such as an oven body as shown in FIGS. 1 & 2. In the present embodiment, the base 10 comprises an elongated channel 12 such as a U-shaped or otherwise conformed metallic member or structure including first and second parallel, spaced-apart side walls 14,16, and a front wall 18 that extends perpendicularly or otherwise transversely between and interconnects the side walls 14,16 along a front edge thereof. A hollow, open space SP is thus defined between the side walls 14,16 and the front wall 18. Typically, the channel 12 is open along rear edges of the side walls 14, 16 on the side opposite the front wall 18 such that the side walls 14,16 and front wall 18 define a U-shaped cross-section, but a rear wall can optionally be provided that extends between and interconnects the side walls 14,16 at a location spaced from the front wall 18 to define a closed or partially closed box structure. The side walls 14,16 each comprise opposite inner and outer faces 14*i*,14*o* and 16*i*, 16*o*, wherein the inner faces 14*i*,16*i* are oriented inwardly toward the space SP and toward the other, opposite side wall 14,16, and wherein the outer faces 14*o*,16*o* are oriented outwardly away from the space SP and outwardly away from the other, opposite side wall 14,16. In one embodiment, the channel 12 is a stamped steel structure or an otherwise formed one-piece metallic or non-metallic structure, but the channel 12 can alternatively comprises multiple metal or non-metallic pieces that are assembled to construct the channel 12. The channel 12 of the base 10 is elongated along a longitudinal adjustment axis X (FIG. 2) such that the channel 12 comprises opposite first and second ends 12*a*, 12*b* that are spaced-apart along the longitudinal adjustment axis X of the channel 12 and base 10.

The front wall 18 of the illustrated channel 12 includes one or more mounting apertures 18A, and the channel 12 is operatively installed by being fixedly and immovably secured to the wall W of the appliance body B using rivets, screws, or other fasteners inserted through the apertures 18A and engaged with the associated appliance body B. Typically, the longitudinal adjustment axis X is oriented parallel to the front wall W or other wall of the appliance body B to which the base 10 is operatively mounted. The channel front wall 18 also comprises an open window or slot 18S (FIG. 1) that opens into the space SP between the side walls 14,16 and that is aligned with a corresponding opening or slot in the appliance body wall W. As shown in FIGS. 1 & 2, the front wall slot 18S of the adjustable receiver AR provides a location that receives the hinge mounting arm HA of the associated hinge H such that the hinge mounting arm HA is received into the channel space SP between the side walls 14,16 when the hinge H is operatively engaged with the adjustable receiver AR to pivotally connect the appliance door D to the appliance body B via hinge assembly H.

As briefly noted above, the adjustable receiver AR comprises first and second mounting structures M1,M2 that are connected to the channel 12 of the base 10 and that are adapted to be engaged by the slots T1,T2 of the hinge mounting arm HA when the associated hinge H is operatively connected to and engaged with the receiver AR. More particularly, the base 10 comprises a first mounting structure M1 adapted to be engaged by and received in the first slot T1 of the hinge mounting arm HA, and comprises a second mounting structure M2 adapted to be engaged by and received in the second slot T2 of the hinge mounting arm HA. In the illustrated embodiment, the first mounting structure M1 comprises a rivet, pin, stud, or other metallic or non-metallic first cross-member CM1 that extends between the first and second side walls 14,16 of the channel 12, and the second mounting structure M2 comprises a portion of the channel 12, itself, such as a portion of the channel front wall 18 that defines a lower edge 18E of the open slot 18S. In the illustrated embodiment, the first mounting structure M1 is selectively movable relative to the base 10/channel 12, and the second mounting structure M2 is fixed in position relative to the base 10/channel 12. The slot T2 of the hinge arm HA engages the fixed mounting structure M2 in a movable manner that allows for movement of the hinge arm HA relative to the fixed mounting structure M2 at least in first and second opposite linear directions along an axis parallel to the longitudinal adjustment axis X of the channel 12 of the base 10 in response to movement of the first mounting structure M1 and the hinge arm HA connected thereto. Alternatively, the second mounting structure M2 is similar to the first mounting structure M1 and also comprises a rivet, pin, stud, or other metallic or non-metallic cross-member that extends between the first and second side walls 14,16 of the channel 12, and such an alternative mounting structure M2 can be fixed relative to the base 10/channel 12 or movable in a manner corresponding to the first mounting structure M1. If the second mounting structure M2 is movable relative to the base 10, the first mounting structure M1 can alternatively be provided by part of the front wall 18 or by another fixed part of the channel 12 or a structure connected thereto. More generally, at least one of the mounting structures M1,M2 is selectively movable relative to the base 10/channel 12, and the other mounting structure M1,M2 can be movable or fixed relative to the base 10/channel 12 and, if fixed in position relative to the channel 12 of the base 10, the fixed mounting structure is shaped and provided such that the corresponding mating slot T1,T2 of the hinge arm HA engages such fixed mounting structure M1,M2 in a movable manner that allows for movement of the hinge arm HA relative to the fixed mounting structure in first and second opposite directions relative to channel 12 of the base 10.

With respect to the first mounting structure M1, the first and second channel side walls 14,16 comprise respective first and second elongated slots ES1,ES2 (see FIGS. 3 & 4) that are aligned or registered with each other on opposite sides of the channel space SP. The first and second elongated slots ES1,ES2 are each elongated such that a first end of each elongated slot ES1,ES2 is located closer to the first end 12*a* of the channel 12, and such that an opposite second end of each elongated slot ES1,ES2 is located closer to the second end 12*b* of the channel 12. The first and second elongated slots ES1,ES2 provide or constitute a first pair of elongated slots included in the channel 12 of the base 10. The first and second elongated slots ES1,ES2 are respectively defined in the first and second sidewalls 14,16 of the channel 12 so as to be located on opposite lateral sides of the base 10.

The first cross-member CM1, which comprises a rivet, shoulder rivet, pin, stud, or other metallic or non-metallic structure (shown herein as a rivet), provides the first mounting structure M1 and includes opposite first and second ends that are respectively located in the first and second elongated slots ES1,ES2, and the first cross-member CM1 is slidably movable in the first pair of elongated slots ES1,ES2 between the opposite first and second ends thereof. In the present example, the first and second elongated slots ES1,ES2 are elongated along respective major axes that lie parallel to the longitudinal adjustment axis X of the channel 12, and the first cross-member CM1 thus moves between the opposite first and second ends of the slots ES1,ES2 along the longitudinal adjustment axis X between first (up or raised), second (middle or intermediate), and third (down or lowered) positions, as shown respectively in FIGS. 7A, 7B, and 7C, or to any position located between such first, second, and third positions.

The first and second channel side walls 14,16 further include respective third and fourth elongated slots ES3,ES4 that are aligned or registered with each other on opposite sides of space S. The third and fourth elongated slots ES3,ES4 are also elongated along respective slot axes such that a first end of each elongated slot ES3,ES4 is located closer to the first end 12*a* of the channel 12, and such that an opposite second end of each elongated slot ES3,ES4 is located closer to the second end 12*b* of the channel 12. The third and fourth elongated slots ES3,ES4 provide or constitute a second pair of elongated slots included in the channel 12 of the base 10. The third and fourth elongated slots ES3,ES4 are respectively defined in the first and second sidewalls 14,16 of the channel 12 so as to be located on opposite lateral sides of the base 10.

The first and third elongated slots ES1,ES3 of the first side wall 14 can be aligned with each other and elongated along a common longitudinal axis, or they can be offset from each other as shown herein. Similarly, the second and fourth elongated slots ES2,ES4 of the second side wall 16 can be aligned with each other and elongated along a common longitudinal axis, or they can be offset from each other as shown herein. Also, the elongated (major) axis of at least the first and second elongated slots ES1, ES2 preferably extends parallel to the front wall 18 of the channel 12 such that the first cross-member CM1 moves in a plane that lies parallel to the front wall 18 of the channel 12 when the first cross-member CM1 moves to and between its first, second, and third operative positions. Similarly, the elongated (major) axis of the third and fourth elongated slots ES3, ES4 preferably extends parallel to the front wall 18 of the channel 12, but can be angled or otherwise positioned relative thereto. A second cross-member CM2, which comprise a rivet, shoulder rivet, pin, stud, or other metallic or non-metallic structure (shown herein as a rivet) includes opposite first and second ends that are respectively located in the third and fourth elongated slots ES3,ES4, and the second cross-member CM2 is slidably movable in the slots ES3,ES4 between the first and second opposite ends thereof. The length of the third and fourth elongated slots ES3,ES4, as defined between the first ends ES3*a*,ES4*a* and the second ends ES3*b*,ES4*b* thereof is preferably equal to or at least as great as a corresponding length of the first and second elongated slots ES1,ES2. The first and second cross-member CM1,CM2 are thus arranged to be parallel and spaced-apart relative to each other.

At least one rigid metallic or non-metallic link, shown herein as first and second spaced-apart links K1,K2, extends between and interconnects the first and second cross-members CM1,CM2. The links K1,K2 join the first and second cross-members CM1,CM2 together as a unit such that when the second cross-member CM2 slidably moves in the third and fourth slots ES3,ES4 toward and away from the opposite first and second ends 12*a*,12*b* of the channel 12, the links K1,K2 correspondingly move the first cross-member CM1 slidably in the first and second slots ES1,ES2 toward and away from the opposite first and second ends 12*a*,12*b* of the channel 12. In the illustrated embodiment, the first and second links K1,K2 are located respectively adjacent the first and second side walls 14,16 of the channel 12, adjacent the respective outer faces of the side walls 14,16. The first link K1 extends between the first end of the first cross-member CM1 and the first end of the second cross-member CM2, and the second link K2 extends between the second end of the first cross-member CM1 and the second end of the second cross-member CM2. The first and second links K1,K2 are arranged to be parallel and spaced-apart from each other and are interconnected at opposite ends thereof by the parallel and spaced-apart cross-members CM1,CM2.

In the illustrated example, the first and second links K1,K2 comprise metallic members that are respectively located adjacent outer faces of the first and second side walls 14,16. Alternatively, one or both of the links K1,K2 are located in the space SP between the side walls, adjacent the respective inner faces of the side walls 14,16. The links K1,K2 are shown as separate components that are each pivotally engaged with the cross-members CM1,CM2 but, in still another alternative embodiment, the one or more links K1,K2 are welded or otherwise integrally secured to or are formed as a one-piece construction with one or both of the cross-members CM1,CM2, e.g., as a one-piece cast or powdered metal structure or by a molded polymeric structure.

Figure 7C:
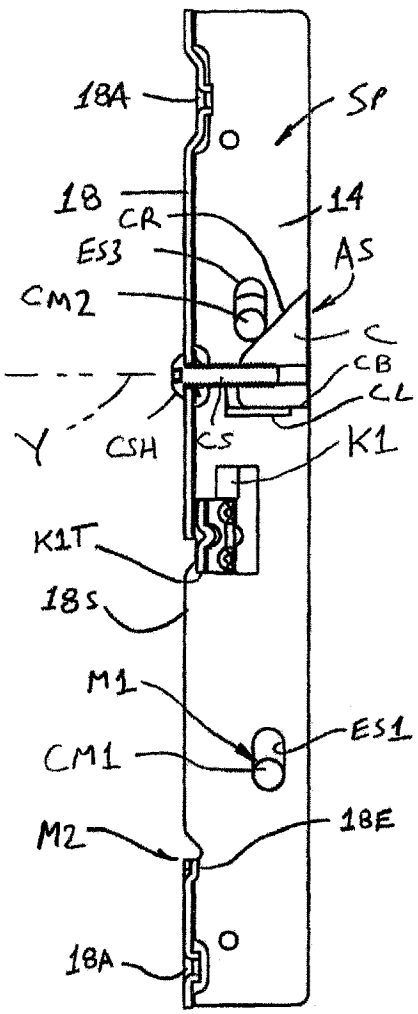
FIGS. 7A, 7B, and 7C are section views that show the adjustable receiver of FIG. 1 in raised (up), intermediate (middle), and lowered (down) positions, respectively.
Figure 7B:
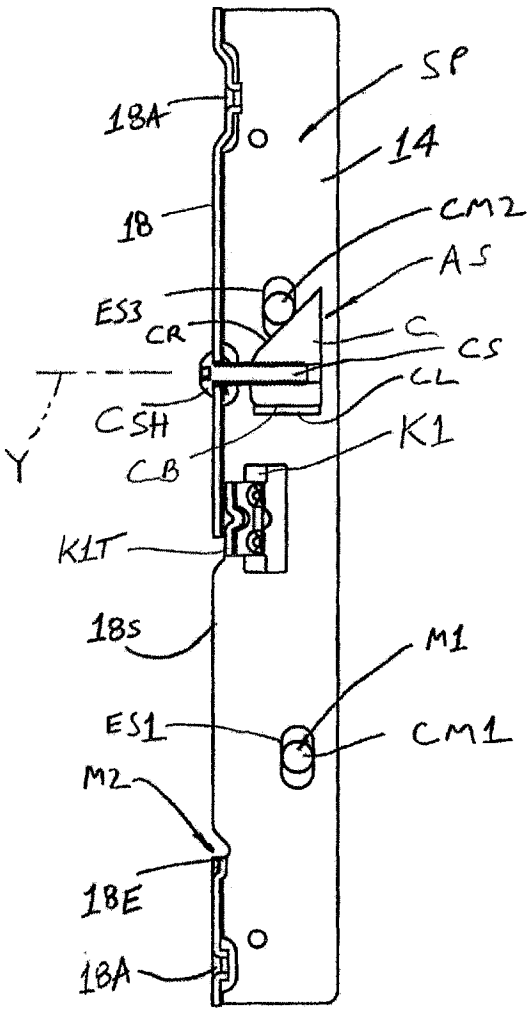
Figure 7A:
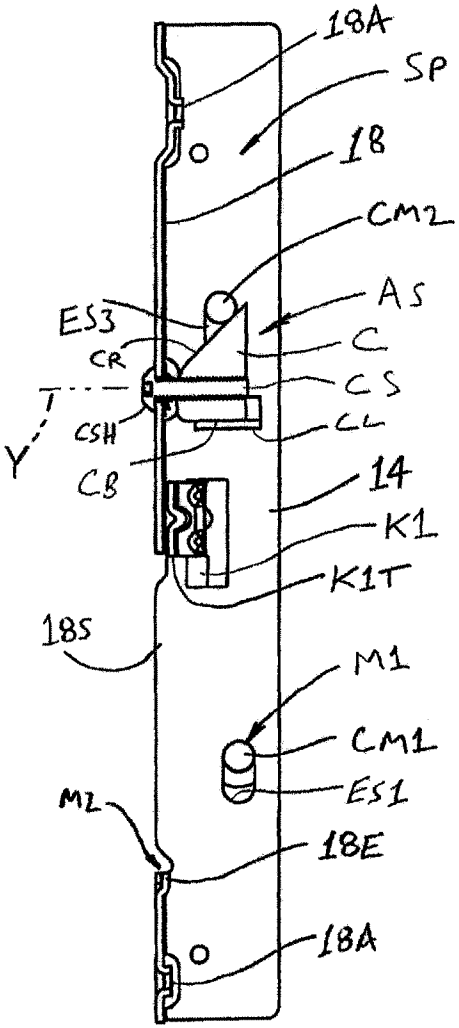

The cross-members CM1,CM2 and the one or more links K1,K2 together form or define an adjustable hinge mounting bracket or hinge mount HM that is selectively movable and adjustable in the elongated slots ES1,ES2,ES3,ES4 relative to the channel 12 of the receiver base 10 along the longitudinal adjustment axis X of the channel 12 or otherwise such that the hinge mount HM is selectively movable to and between first (up), second (intermediate), and third (down) positions relative to the channel 12 corresponding to the first (up), second (middle), and third (down) positions of the first cross-member CM1 in the first and second elongated slots ES1,ES2 as shown respectively in FIGS. 7A, 7B, and 7C. In one example, the channel 12 is mounted to a vertical front wall W of an oven body or other appliance body B so that the longitudinal adjustment axis X thereof is vertically oriented and at least the first cross-member CM1 of the hinge mount HM is selectively vertically movable and adjustable relative to the channel 12 along the longitudinal adjustment axis X. Those of ordinary skill in the art will recognize that the position of the hinge mount HM along the adjustment axis X correspondingly controls the position of the first hinge mounting structure M1 and, thus, correspondingly controls the position of the hinge mounting arm HA mated with the first and second hinge mounting structures M1,M2 to control the position of the associated hinge H and associated appliance door D connected thereto relative to the base 10 of the adjustable receiver AR and relative to the appliance body B.

The adjustable receiver AR includes an adjustment system AS (FIGS. 7A, 7B, 7C) for selectively altering a/the position of the hinge mount HM relative to the channel 12 of the base 10. In the illustrated embodiment, the adjustment system comprises a cam C movably supported by the channel 12 in the space SP, and further includes a cam adjuster such as a cam adjustment screw CS threaded into or otherwise operably engaged with the cam C and adapted to move the cam C relative to the channel 12 of the base 10. In particular, the cam C is supported by the channel 12 and is adapted to move relative to the channel 12 of the base 10 in the space SP in a linear reciprocal manner along a cam movement axis Y that is arranged perpendicular or otherwise transverse relative to the longitudinal adjustment axis X of the channel 12 of the base 10. The adjustment screw CS is shown herein as having its longitudinal axis being coaxially located on or parallel to the cam movement axis Y. Alternatively, the adjustment screw CS can be located so that its longitudinal axis is arranged transversely relative to the cam movement axis Y and/or transversely relative to the side walls 14,16 so that the adjustment screw CS extends perpendicularly or otherwise transversely relative to one or both side walls 14,16 and, in such case, the cam movement axis Y can optionally also be arranged perpendicularly or otherwise transversely relative to one or both side walls 14,16. In the illustrated embodiment, one or both of the channel side walls 14,16 comprises a flange or other support ledge CL projecting into the space SP from the inner surface 14*i*,16*i* of the side wall 14,16 toward the other side wall 14,16 and on which a base CB of the cam C is slidably supported. As shown herein, the first and second side walls 14,16 include respective cam support ledges CL, each defined by a turned in flange of the respective side wall 14,16 that projects into the space SP toward the other, opposite side wall 14,16, and the cam support ledges CL are aligned with each other on opposite sides of the space SP. The support ledges CL are arranged perpendicular relative to the longitudinal adjustment axis X and extend parallel to the cam movement axis Y, and the base of the cam CB is flat such that the cam C is movable in a linear reciprocal manner relative to the channel 12 in first and second opposite directions (toward and away from the front wall 18 of the channel 12 as can be seen by comparing FIGS. 7A, 7B, and 7C) on the support ledges CL. The cam C can be slidably or movably supported relative to the base 10/channel 12 using any other suitable structures or means such as one or more fasteners that extend through corresponding slots defined in the cam C or the like.

The cam C includes an operative ramp surface CR that is inclined, contoured, and/or otherwise arranged to be offset and non-parallel with respect to the cam base CB. The ramp surface CR of the cam C is abutted or otherwise operatively engaged with the second cross-member CM2 and/or is abutted or operatively engaged with another part of the adjustable hinge mount HM (i.e., the first and second cross-members CM1,CM2 and the one or more links K1,K2) or a structure connected or engaged with the hinge mount HM such that movement of the cam C on the cam movement axis Y causes the cam ramp surface CR to slide relative to the second cross-member CM2 or other part of the hinge mount HM abutted therewith such that the cam ramp surface CR alters the location of the second cross-member CM2 in the elongated slots ES3,ES4 and, thus, corresponding alters the location of the first cross-member CM1 in the first and second elongated slots ES1,ES2. In one example, as illustrated herein, the hinge mount HM is urged only by gravity toward its third operative (down) position. Alternatively, a spring is operatively connected between the channel 12 and the hinge mount HM and urges or biases the hinge mount HM toward its third operative (down) position. In another alternative embodiment, the ramp surface CR of the cam C is provided as part of an elongated slot defined in the cam C and in which the second cross-member CM2 is slidably located such that movement of the cam C in a first direction urges the second cross-member CM2 toward the second end 12*b* of the channel 12 and movement of the cam C in a second direction urges the second cross-member CM2 in a second direction away from the second end 12*b* of the channel 12. In still another alternative embodiment, the cam C or another structure such as a link member or linkage is rotatably or otherwise moveably connected to the channel 12 and adapted to rotate or otherwise move relative to the channel 12 to alter the position of the second cross-member CM2 or other part of the hinge mount HM relative to the channel 12.

The cam adjustment screw CS extends through the front wall 18 of the channel 12 into the space SP so that a head CSH of the adjustment screw CS is located outside the space SP adjacent the front wall 18 and accessible to a user and is selectively rotatable by a user manually with our without an associated tool such as a screwdriver, wrench or the like. The cam adjustment screw CS is rotatable relative to the front wall 18 but is captured to the front wall 18 to prevent axial movement of the cam adjustment screw CS relative to the front wall. The cam adjustment screw CS is threadably engaged with the cam C such that rotation of the cam adjustment screw CS in a first direction draws the cam toward the channel front wall 18 on the cam movement axis Y so that the cam ramp surface CR urges the second cross-member CM2 toward the second end 12*b* of the channel toward the first operative (up) position of the hinge mount HM, and rotation of the cam adjustment screw CS in a second direction that is opposite the first direction urges the cam C away from the channel front wall 18 such that the cam ramp surface CR causes or allows the second cross-member CM2 or other part of the hinge mount HM to move away from the second end 12*b* of the channel 12 toward the third operative (down) position of the hinge mount HM by gravity, spring force or by direct urging of the cam C. The cam C is thus movable in a linear, reciprocal manner along the cam movement axis Y toward and away from the front wall 18 of the base 10.

To adjust the position of an appliance door D relative to the appliance body B, the door D is opened (or removed) to allow access to the cam adjustment screw CS. A user rotates the cam adjustment screw CS in the first direction to raise the hinge mount HM/first mounting structure M1 (optionally with hinge H connected thereto) toward the second end 12*b* of the channel 12, or the user rotates the cam adjustment screw CS in the opposite second direction to lower the hinge mount HM/first mounting structure M1 (optionally with hinge H connected thereto) toward the first end 12*a* of the channel 12.

In an alternative embodiment, the cam adjustment screw CS is omitted and another cam adjuster is provided for directly or indirectly adjusting the position of the cam C relative to the channel 12, such as a lever operably connected to or formed as part of the cam C that is moved by a user to alter the position of the cam C relative to the channel 12.

As shown herein, at least one of the links K1,K2 (the first link K1 as shown herein) comprises a lock tab K1T that is provided as a part thereof or that is connected thereto. The lock tab K1T projects through the side wall 14 or through the slot 18S or otherwise into the channel space SP so as to be located adjacent the slot 18S. The associated hinge H includes a latch L (FIGS. 1 & 2) that is pivotally, slidably, resiliently, and/or otherwise movably connected to the hinge arm HA (the latch L is shown herein as being pivotally connected to the hinge arm HA). When the hinge arm HA is operatively engaged with the first and second hinge mounting structures M1,M2, the latch L is moved to a latched position as shown herein where the latch abuts the lock tab K1T. Abutment of the latch L with the lock tab K1T prevents disengagement of the hinge arm HA from the first and second mounting structures M1,M2 by preventing lifting movement of the hinge arm HA relative to the first and second mounting structures M1,M2. Because the lock tab K1T is connected to the link K1 (and/or link K2) the lock tab K1T moves with the hinge mount HM when the position of the hinge mount HM is adjusted relative to the base 10/channel 12 so that the hinge latch L remains abutted with the lock tab K1T for all operative positions of the hinge mount HM. To disengage the hinge arm HA from the adjustable receptacle AR, the latch L is manually moved away from the lock tab K1T to allow the hinge arm HA to be lifted out of engagement with the first and second hinge mounting structures M1,M2.

It is intended that the following claims be construed as broadly as possible, while preserving their validity, in order to encompass variations, alternatives, modifications, improvements, equivalents, and substantial equivalents of the embodiments and teachings disclosed herein.

The invention claimed is:

1. An adjustable receiver for an associated appliance hinge, said adjustable receiver comprising:

a base adapted to be secured to an associated appliance body;

a first cross-member connected to the base and movable relative to the base, said first cross-member providing a first hinge mounting structure for an associated appliance hinge;

a second cross-member connected to the base and movable relative to the base;

at least one link that extends between and interconnects the first and second cross-members, wherein said first and second cross-members and said at least one link define an adjustable hinge mount that is selectively movable relative to said base along an adjustment axis;

an adjustment system for selectively altering a position of the adjustable hinge mount relative to the base along the adjustment axis;

said base comprising a channel that includes first and second spaced-apart side walls located respectively on opposite first and second lateral sides of said base and a front wall that extends between and connects the first and second side walls such that a space is defined between the first and second side walls;

said front wall including a front wall slot defined therein that opens into the space defined between the first and second side walls;

first and second elongated slots provided in said base respectively on said first and second lateral sides of said base;

third and fourth elongated slots provided in said base respectively on said first and second lateral sides of said base;

wherein said first and third elongated slots are defined in the first side wall and the second and fourth elongated slots are defined in the second side wall;

the first cross-member extending between the first and second elongated slots through the space;

the second cross-member extending between the third and fourth elongated slots through the space;

wherein the first and second side walls each comprises opposite inner and outer faces, said respective inner faces of the first and second side walls oriented inwardly toward each other, wherein said at least one link is located outside of the space, adjacent the outer face of the first side wall or adjacent the outer face of the second side wall.

2. The adjustable receiver as set forth in claim 1, wherein the at least one link comprises first and second links.

3. The adjustable receiver as set forth in claim 2, wherein the first and second links are both located outside the space, with the first link is located adjacent the outer face of the first side wall and the second link located adjacent the outer face of the second side wall.

4. The adjustable receiver as set forth in claim 1, wherein the adjustment system comprises:

a cam located in the space between the first and second side walls and movable relative to the channel; and, a cam adjuster connected to the channel and operably engaged with the cam such that manual movement of the cam adjuster moves the cam relative to the channel.

5. The adjustable receiver as set forth in claim 4, wherein said first and second side walls of the channel comprise respective first and second cam support ledges that project into the space, and wherein said cam is movably support on said first and second cam support ledges.

6. The adjustable receiver as set forth in claim 5, wherein said cam is movable on a cam movement axis toward and away from said front wall in response to manual movement of the cam adjuster, wherein said cam movement axis is oriented transversely relative to said adjustment axis.

7. The adjustable receiver as set forth in claim 6, wherein the cam comprises a ramp surface that is abutted with the adjustable hinge mount.

8. The adjustable receiver as set forth in claim 7, wherein the ramp surface of the cam is abutted with the second cross-member of the adjustable hinge mount.

9. The adjustable receiver as set forth in claim 7, wherein the cam adjuster comprises a cam adjustment screw that is engaged with the cam and rotatable relative to the channel.

10. The adjustable receiver as set forth in claim 9, wherein the adjustment screw extends into the space through the front wall of the channel and comprises a head that is located outside the space adjacent the front wall, said head adapted to be manually rotated relative to the channel to rotate the adjustment screw in first and second opposite directions, wherein rotation of the adjustment screw in a first direction draws the cam toward the front wall on the cam movement axis so that the cam ramp surface urges the adjustable hinge mount toward a first operative position relative to the base along the adjustment axis, and rotation of the cam adjustment screw in the second direction urges the cam away from the front wall such that the cam ramp surface permits the adjustable hinge mount to move away from the first operative position along the adjustment axis.

11. The adjustable receiver as set forth in claim 10, wherein said adjustable hinge mount is movable away from said first operative position toward a second operative position and toward a third operative position upon rotation of the adjustment screw in said second direction, wherein said second operative position is located between said first and third operative positions along the adjustment axis.

12. The adjustable receiver as set forth in claim 1, wherein the adjustable hinge mount further comprises a lock tab located adjacent the front wall slot of the base and adapted to be engaged by a latch of an associated appliance hinge mated with the adjustable receiver.

13. An adjustable receiver for an associated appliance hinge, said adjustable receiver comprising:

a base adapted to be secured to an associated appliance body;

a first cross-member connected to the base and movable relative to the base, said first cross-member providing a first hinge mounting structure for an associated appliance hinge;

a second cross-member connected to the base and movable relative to the base;

at least one link that extends between and interconnects the first and second cross-members, wherein said first and second cross-members and said at least one link define an adjustable hinge mount that is selectively movable relative to said base along an adjustment axis;

an adjustment system for selectively altering a position of the adjustable hinge mount relative to the base along the adjustment axis;

said base comprising a channel that includes first and second spaced-apart side walls and a front wall that extends between and connects the first and second side walls such that a space is defined between the first and second side walls;

said front wall of said base including a front wall slot defined therein that opens into the space defined between the first and second side walls;

said base comprising: (i) first and third elongated slots defined in the first side wall; and (ii) second and fourth elongated slots defined in the second side wall;

wherein the first cross-member extends between the first and second elongated slots through the space and the second cross-member extends between the third and fourth elongated slots through the space;

said first and second side walls each comprising opposite inner and outer faces, wherein said respective inner faces of the first and second side walls are oriented inwardly toward each other and wherein said at least one link is located outside of the space adjacent the outer face of the first side wall.

14. The adjustable receiver as set forth in claim 13, wherein the at least one link comprises first and second links that are both located outside the space, wherein with the first link is located adjacent the outer face of the first side wall and the second link located adjacent the outer face of the second side wall.

15. The adjustable receiver as set forth in claim 14, wherein the adjustment system comprises:

a cam located in the space between the first and second side walls and movable relative to the channel; and, a cam adjuster connected to the channel and operably engaged with the cam such that manual movement of the cam adjuster moves the cam relative to the channel.

16. The adjustable receiver as set forth in claim 15, wherein said first and second side walls of the channel comprise respective first and second cam support ledges that project into the space, and wherein said cam is movably support on said first and second cam support ledges for reciprocal movement on a cam movement axis toward and away from said front wall in response to manual movement of the cam adjuster, wherein said cam movement axis is oriented transversely relative to said adjustment axis.

17. The adjustable receiver as set forth in claim 16, wherein the cam comprises a ramp surface that is abutted with the adjustable hinge mount.

18. The adjustable receiver as set forth in claim 17, wherein the ramp surface of the cam is abutted with the second cross-member of the adjustable hinge mount.

19. The adjustable receiver as set forth in claim 15, wherein the cam adjuster comprises a cam adjustment screw that is engaged with the cam and rotatable relative to the channel.

20. The adjustable receiver as set forth in claim 19, wherein the adjustment screw extends into the space through the front wall of the channel and comprises a head that is located outside the space adjacent the front wall, said head adapted to be manually rotated relative to the channel to rotate the adjustment screw in first and second opposite directions, wherein rotation of the adjustment screw in a first direction draws the cam toward the front wall on the cam movement axis so that the cam ramp surface urges the adjustable hinge mount toward a first operative position relative to the base along the adjustment axis, and rotation of the cam adjustment screw in the second direction urges the cam away from the front wall such that the cam ramp surface permits the adjustable hinge mount to move away from the first operative position along the adjustment axis.

* * * * *